US005537827A

United States Patent [19]

Low et al.

[11] Patent Number: 5,537,827

[45] Date of Patent: Jul. 23, 1996

[54] METHOD FOR LIQUEFACTION OF NATURAL GAS

[76] Inventors: William R. Low, 1000 Grandview Rd.; Clarence G. Houser, 1803 SE. Harned Dr., both of Bartlesville, Okla. 74006; Douglas E. Yates, 304 Loma Linda La., Borger, Tex. 79007; Donald L. Andress, 306 Stoneridge, Bartlesville, Okla. 74006

[21] Appl. No.: 484,398

[22] Filed: Jun. 7, 1995

[51] Int. Cl.[6] ..... F25J 1/00

[52] U.S. Cl. ..... 62/613

[58] Field of Search ..... 62/9, 38

[56] References Cited

U.S. PATENT DOCUMENTS

| | | | |
|---|---|---|---|
| 4,172,711 | 10/1979 | Bailey | 62/21 |
| 4,456,459 | 6/1984 | Brundige, Jr. | 62/9 |
| 4,923,492 | 5/1990 | Hewitt | 62/11 |
| 4,970,867 | 11/1990 | Herron et al. | 62/11 |
| 5,291,736 | 3/1994 | Paradowski | 62/20 |
| 5,363,655 | 11/1994 | Kikkawa et al. | 62/9 |
| 5,473,900 | 12/1995 | Low | 62/9 |

OTHER PUBLICATIONS

Barber et al (literature), "Optimized cascade process works well for LNG plans", Oil and Gas Journal, pp. 88–92

Turboexpanders (literature), pp. 13–40 to 13–47.

*Primary Examiner*—Ronald C. Capossela

*Attorney, Agent, or Firm*—Ryan N. Cross

[57] ABSTRACT

A process for the liquefaction of natural gas having a pressure above atmospheric pressure, is disclosed in which a feed gas is cooled to sequentially lower temperatures, by passing the gas through a plurality of cooling stages, in heat exchange with at least three refrigerants, until the gas is substantially completely condensed in the last of the cooling stages. The pressure of the feed gas is reduced to near atmospheric pressure during the cooling of the feed gas by the use of hydraulic expanders which extract work during pressure reduction. Additionally, pressure reduction of the refrigerants within the refrigerant cycles is performed by similar hydraulic expanders. The work extracted by said hydraulic expanders is used to provide power to the liquefaction process, such as by helping to power compressors or pumps used in the liquefaction process.

15 Claims, 5 Drawing Sheets

METHOD FOR LIQUEFACTION OF NATURAL GAS

BACKGROUND OF THE INVENTION

The present invention relates to a refrigeration process for liquefying a gas. More particularly, the present invention relates to a process for the liquefaction of natural gas which is more energy efficient than prior methods and, thus, more economical.

Numerous reasons exist for the liquefaction of gases and particularly of natural gas. The primary reason for the liquefaction of natural gas is that the liquefaction reduces the volume of a gas by a factor of about 1/600, thereby making it possible to store and transport the liquefied gas in containers of more economical and practical design.

For example, when gas is transported by pipeline from the source of supply to a distant market, it is desirable to operate under a substantially constant high load factor. Often the capacity will exceed demand while at other times the demand may exceed the capacity of the pipeline. In order to shave off the peaks where demand would exceed supply, it is desirable to store the gas when the supply exceeds demand, thereby peaks in demand can be met from material in storage. For this purpose it is desirable to provide for the storage of gas in a liquefied state and to vaporize the liquid as demand requires.

Liquefaction of natural gas is of even greater importance in making possible the transport of gas from a source of plentiful supply to a distant market, particularly when the source of supply cannot be directly joined with the market by pipeline. This is particularly true where transport must be made by ocean going vessels. Ship transportation in the gaseous state is uneconomical unless the gaseous material is highly compressed, and even then the transportation system would not be economical because it is impractical to provide containers of suitable strength and capacity.

In order to store and transport natural gas, the reduction of the natural gas to a liquefied state requires cooling to a temperature of about −240° F. to −260° F. at atmospheric pressure.

Numerous systems exist in the prior art for the liquefaction of natural gas or the like, in which the gas is liquefied by passing it sequentially through a plurality of cooling stages to cool the gas to successively lower temperatures until the liquefaction temperature is reached. Cooling is generally accomplished by heat exchange with one or more refrigerants such as propane, propylene, ethane, ethylene, and methane which are expanded in a closed refrigeration cycle. Additionally, the natural gas is expanded to atmospheric pressure by passing the liquefied gas through one or more expansion stages. During the course of the expansion, the gas is further cooled to a suitable storage or transport temperature and its pressure reduced to atmospheric pressure. In this expansion to atmospheric pressure significant volumes of the natural gas are flashed. The flashed vapors from the expansion stages are generally collected and recycled for liquefaction or else burned to generate power for the liquid natural gas manufacturing facility.

These prior liquefaction processes have typically carried out the depressurization of the natural gas feed by Joule-Thompson expansion, or constant enthalpy expansion, and has resulted in a reduced pressure and temperature for the gas feed system. Such expansions are uneconomical and wasteful because the gas expands without doing any useful work. Therefore, it would be desirable to develop a liquefaction process which extracts useful work from expansion of the gas feed stream. Moreover, it would be desirable to develop a more efficient arrangement for a process for the liquefaction of natural gas.

SUMMARY OF THE INVENTION

It is, therefore, an object of the present invention to provide a more economical and efficient process for the liquefaction of natural gas.

Another object of the present invention is to provide an improved process for the liquefaction of natural gas that overcomes the disadvantages of a Joule-Thompson expansion to provide a more economical and efficient liquid natural gas manufacturing process.

In accordance with the present invention, there is provided a process for producing liquefied natural gas from a pressurized natural gas feed stream, which is predominantly methane and has an initial pressure above about 500 psia, comprising: introducing the feed stream into heat exchange contact with a first refrigerant cycle wherein the temperature of the feed stream is reduced by heat exchange with a first portion of a first refrigerant having a first boiling point, to thus produce a first cooled stream; introducing the first cooled stream into heat exchange contact with a second refrigerant cycle wherein the temperature of the first cooled stream is reduced by heat exchange with a second refrigerant, having a second boiling point lower than the first boiling point, to thus produce a second cooled stream, and wherein within the second refrigerant cycle the second refrigerant is subsequently compressed and, at least partially, cooled and condensed by heat exchange with a second portion of the first refrigerant; and reducing the pressure and temperature of the second cooled stream in a series of cooling and expansion steps utilizing at least one heat exchanger, at least one hydraulic expander and at least one separation vessel to produce a liquid methane stream at about atmospheric pressure, wherein the second cooled stream is cooled within the heat exchanger by heat exchange with a third refrigerant having a third boiling point lower than the second boiling point, the pressure of the second cooled stream is reduced in the hydraulic expander such that the temperature of said second cooled stream is further reduced and work is extracted during the pressure reduction, and a gaseous phase is separated from the second cooled stream in the separation vessel.

According to another aspect of the invention, there is provided a process for producing liquefied natural gas, from a pressurized natural gas feed stream, which is predominantly methane and has an initial pressure above about 500 psia, comprising: introducing the feed stream into heat exchange contact with a first refrigerant cycle wherein the temperature of the feed stream is reduced by heat exchange with a first portion of a first refrigerant having a first boiling point, to thus produce a first cooled stream; introducing the first cooled stream into heat exchange contact with a second refrigerant cycle wherein the temperature of the first cooled stream is reduced by heat exchange with a second refrigerant having a second boiling point lower than the first boiling point, to thus produce a second cooled stream; compressing the second refrigerant after it has undergone heat exchange with the first cooled stream to increase the pressure of said second refrigerant; cooling the second refrigerant after the compressing of the second refrigerant by heat exchange with a second portion of the first refrigerant to thus decrease the temperature of the second refrigerant and at least partially condense it; reducing the pressure of the thus cooled second refrigerant in a second refrigerant hydraulic expander to further reduce the temperature of the second refrigerant wherein work is extracted from the second refrigerant during the reduction of pressure by means of the second refrigerant hydraulic expander; thereafter returning the second refrigerant for heat exchange with the first cooled feed stream; combining the first portion of the first refrigerant, after it has undergone heat exchange with the feed stream, with the second portion of the first refrigerant, after it has undergone heat exchange with the second refrigerant, to produce a first refrigerant stream; compressing the first refrigerant stream to increase the pressure of the first refrigerant stream; subsequently, cooling the first refrigerant stream by heat exchange with a cooling medium, to thus decrease the temperature of the first refrigerant stream and at least partially condense it; reducing the pressure of the thus cooled first refrigerant stream in a first refrigerant hydraulic expander to further reduce the temperature of the first refrigerant stream wherein work is extracted from the first refrigerant stream during the reduction in pressure by means of the first refrigerant hydraulic expander; and thereafter splitting the first refrigerant stream into the first portion of the first refrigerant and the second portion of the first refrigerant and returning the first portion for heat exchange with the feed stream and returning the second portion for heat exchange with the second refrigerant.

BRIEF DESCRIPTION OF THE DRAWINGS

FIG. 1 illustrates the cooling of the feed gas by a first refrigerant and by a second refrigerant.

FIG. 2 illustrates the cooling of the feed gas by heat exchange with a third refrigerant and by the use of hydraulic expanders.

DETAILED DESCRIPTION OF THE PREFERRED EMBODIMENTS

Figure 1:
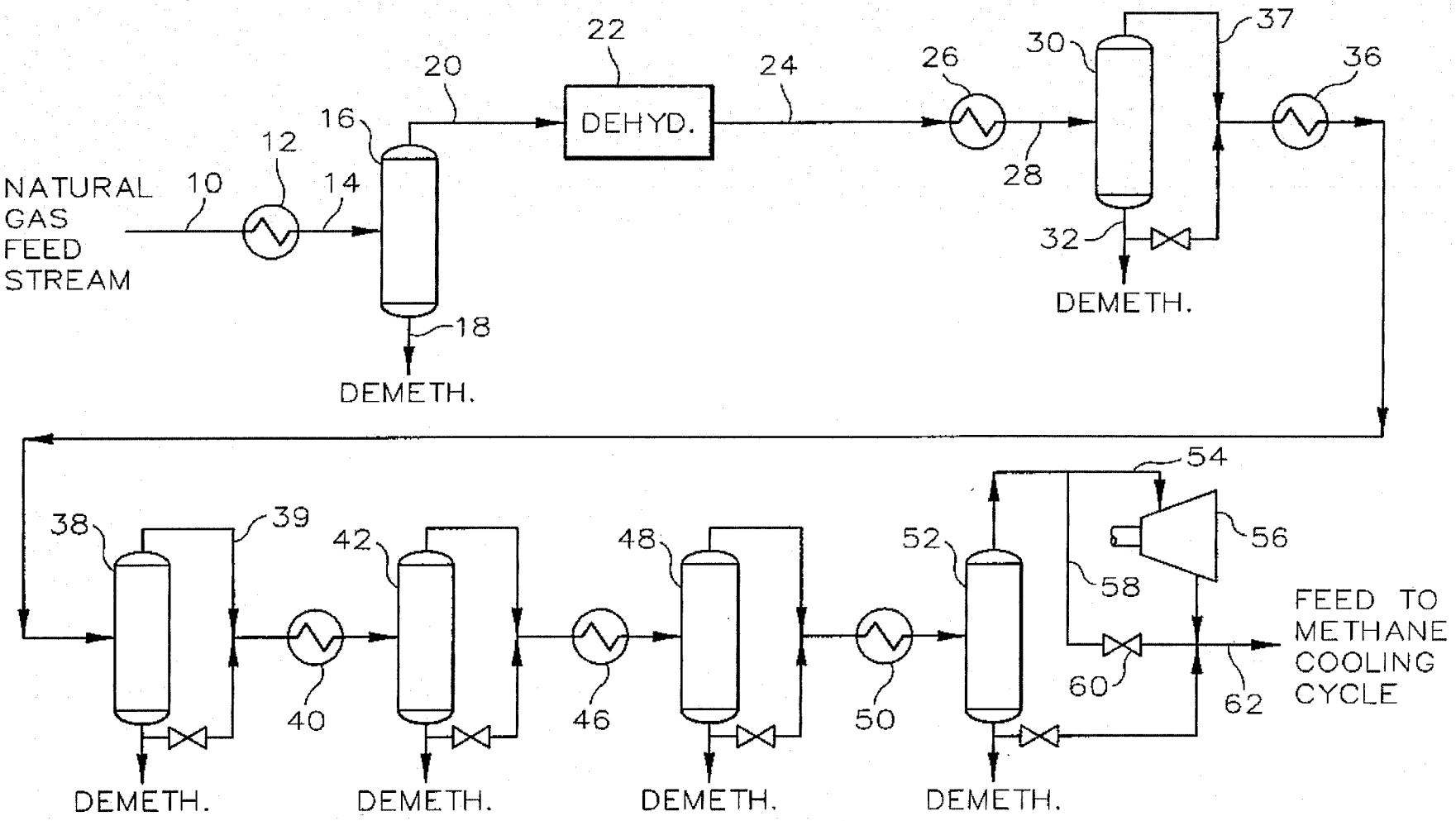
FIG. 1 shows a simplified flow diagram of the first portion of a liquefaction process according to the present invention.

The detailed description of the present invention will be made with reference to the liquefaction of a lean natural gas and specific reference will be made to the liquefaction of lean natural gas having an initial pressure of about 500 psia or above and at ambient temperature. It is to be understood that, where reference is made to a lean natural gas, this term refers to a gas that is predominantly methane, for example, 85% by volume methane, with the balance being ethane, higher hydrocarbons, nitrogen and a minor amount of contaminants.

In the process of the current invention, the feed gas is cooled to its liquefaction temperature by passing the same through a plurality of cooling stages maintained at successively lower temperatures. Any suitable combination of refrigerants may be employed. For example, because of their availability and cost, preferred refrigerants are propane, propylene, ethane, ethylene, methane and other normally gaseous materials, which have been compressed to liquefy the same. The combination of refrigerants should be such that the refrigerant utilized in a latter portion of the cooling train will have a boiling point lower than the refrigerant utilized in the earlier stages of the cooling train. In the preferred embodiment, propane is utilized in a first refrigerant cycle of the cooling train, ethylene is utilized in a second refrigerant cycle of the cooling train, and methane is used in a third refrigerant cycle of the cooling train.

Any number of cooling stages may be employed with each refrigerant, depending upon the composition, temperature and pressure of the feed gas. When the feed gas is a lean natural gas at a pressure in the neighborhood of 500 psia or greater and at ambient temperature, it is preferred that three or more stages of cooling, using propane as a refrigerant, be followed by three or more stages of cooling, using ethylene as a refrigerant.

Preferably, the first refrigerant will be compressed to liquefy the same while each of the downstream refrigerants is cascaded with a previous refrigerant, that is, the downstream refrigerant is cooled to its liquefaction temperature by heat exchange with a portion or portions of a previous refrigerant. In the preferred process being described, the propane is liquefied by compression and cooled by heat exchange with air or water. Subsequently, compressed ethylene is cooled to its liquefaction temperature by a plurality of heat exchange contacts, preferably three, with the cooled propane, wherein the cooled propane is expanded to successively lower pressures and, hence, successively lower temperatures prior to each contact. Similarly, the methane is cooled by a plurality of heat exchange contacts with propane and/or ethylene, expanded to successively lower pressures and, hence, successively lower temperatures.

The inventive process uses several types of cooling including heat exchange, vaporization and expansion or pressure reduction. Heat exchange, as used herein, refers to processes wherein the refrigerant cools the substance to be cooled without actual physical contact between the refrigerant and the substance to be cooled, such as heat exchange undergone in a tube-and-shall heat exchanger, a core-in-kettle heat exchanger, and a brazen aluminum plate-fin heat exchanger. The physical state of the refrigerant and substance to be cooled can vary depending on the demands of the system and the type of heat exchanger chosen. Thus, in the inventive process, a shell-and-tube heat exchanger will typically be utilized where the refrigerant is in a liquid state and the substance to be cooled is in a liquid or gaseous state, whereas, a plate-fin heat exchanger will typically be utilized where the refrigerant is in a gaseous state and the substance to be cooled is in a liquid state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance. Thus, during the vaporization, the portion of the substance which evaporates absorbs heat from the portion of the substance which remains in a liquid state and, hence, cools the liquid portion.

Finally, in expansion or pressure reduction cooling, the pressure of the substance to be cooled is reduced and, correspondingly, the temperature of the substance is reduced. In the inventive process described below, the above mentioned types of cooling are used, often with two or more such types in combination, to achieve a more efficient refrigeration process.

Following the first stage of cooling, water should be removed from the natural gas feed to prevent freezing and plugging of lines and equipment. The water should be removed prior to any subsequent cooling of the natural gas feed. Water may be removed through an appropriate dehydrator, such as a molecular sieve.

Also, following the first stage of cooling, hydrocarbons heavier than methane may be removed from the gas being processed, as necessary or desired. The necessity and/or desirability of removing heavy hydrocarbons as well as the point or points of removal will depend upon the composition of the gas being processed and the desired composition of the liquefied gas product. In one embodiment, heavy hydrocarbons are removed following the first, second and third stages of propane cooling and the first, second and third stages of ethylene cooling. The condensed heavy hydrocarbons are then sent to an appropriate demethanizer column for separation of methane entrained in the condensed heavy hydrocarbons. The methane can be recycled to the feed gas at an appropriate point and the heavy hydrocarbons can be recovered as a natural gas liquids product. In the present example, further control of the composition of the liquefied gas product is attained by separating and returning to the feed gas stream, all or part of the separated liquids. As indicated previously, the heavy hydrocarbon separation can be eliminated or a fewer or larger number of separations carried out. Also, depending on the composition of the condensed heavy hydrocarbons, a demethanizer, a deethanizer and/or natural gas liquid separators may be appropriately used to further separate or remove the liquids.

Cooling is at least partially affected in the cooling stages of this embodiment by reducing the pressure of the liquefied refrigerant by expansion and/or vaporization in an hydraulic expander, and then indirectly contacting the refrigerant with the feed gas in heat exchange relationship. Where more than one stage is employed for a particular refrigerant, each successive stage of refrigerant is expanded to a lower pressure and, hence, a lower temperature. In a multiple stage refrigerant cycle, parallel streams of the refrigerant may be passed to the different stages or the refrigerant may be passed through the stages in series, with the unflashed liquid from each stage being passed to the next succeeding stage.

In one embodiment of the inventive process, the methane vapors produced while reducing the pressure of the liquefied natural gas are passed in countercurrent, heat exchange with the liquefied natural gas stream, and, thus, the methane vapors act as a refrigerant. After heat exchange, the methane vapors are compressed in a methane compressor or compressors. Following compression, the methane refrigerant is cooled by heat exchange, preferably with one of the prior refrigerants used, and then rejoined with the feed gas stream prior to its entering the methane refrigerant cycle.

The preferred embodiment of the present invention will be understood more fully by reference to the drawings.

Referring to FIG. 1 of the drawings, a lean natural gas feed stream at above about 500 psia and at ambient temperature is introduced to the system through conduit 10. The subject feed gas can be pre-treated to remove acid gases such as carbon dioxide, hydrogen sulfide and the like by processes such as amine extraction. The feed stream also can be treated in a molecular sieve dehydrator to remove water from the natural gas stream. The water must be removed to prevent freezing and plugging of the conduits and heat exchangers at the temperatures encountered in the process. Additionally, the lean natural gas feed stream can be precooled by heat exchange with air, with chilled water or with another cooling medium.

After precooling, the lean natural gas enters the first stage of cooling utilizing a first refrigerant. The lean natural gas feed stream enters heat exchanger 12, preferably a shell-and-tube heat exchanger, via conduit 10 and undergoes heat exchange with a first refrigerant, preferably propane. The propane refrigerant used is from the propane refrigerant cycle, which is described below with reference to FIG. 3. Next, the feed stream is sent to separation vessel 16 via conduit 14. Within separation vessel 16, liquefied hydrocarbons, such as pentane, hexane and the like, are removed from the bottom of vessel 16 via conduit 18 and treated in a demethanizer column. Natural gas is removed through conduit 20 and introduced into dehydrator 22 where the natural gas is treated to remove water from the natural gas stream. The water must be removed to prevent freezing and plugging of the conduits and heat exchangers at the temperatures encountered in the process. Dehydrator 22 contains a common gas desiccant such as a molecular sieve. From dehydrator 22, the natural gas enters heat exchanger 26, preferably a core-in-kettle heat exchanger, via conduit 24 and undergoes heat exchange with propane. Cooling in heat exchanger 26 is the second cooling stage of heat exchange contact with the propane refrigerant cycle. The cooled natural gas is then introduced into separation vessel 30 through conduit 28. Within separation vessel 30 additional hydrocarbons are separated out and fractionated in a demethanizer. The hydrocarbons are removed from the bottom of separation vessel 30 via conduit 32 and the natural gas is removed from the top of separation vessel 30 via conduit 37. The natural gas portion from separator 30 is then cooled again in a third cooling stage by heat exchange with propane in heat exchanger 36, preferably a core-in-kettle heat exchanger, followed by further separation of the methane gas from heavier hydrocarbons in separation vessel 38.

After heat exchange in the propane refrigerant cycle, the cooled natural gas is introduced into heat exchange contact with the second refrigeration cycle via conduit 39 wherein the natural gas undergoes heat exchange with a second refrigerant, preferably ethylene, in heat exchanger 40, preferably a core-in-kettle heat exchanger, and, similar to the propane refrigerant cycle, is then introduced into a separation vessel 42 where natural gas is separated from heavier hydrocarbons which are introduced to a demethanizer. The second cooling stage of the ethylene refrigerant cycle is similar to the first stage, with natural gas from separator 42 being cooled by heat exchange with ethylene in heat exchanger 46, preferably a core-in-kettle heat exchanger, and heavier hydrocarbons and water being separated from the methane gas in separation vessel 48. Similarly, the third cooling stage of the ethylene refrigerant cycle comprises natural gas from separator 48 being cooled by heat exchange with ethylene in heat exchanger 50, preferably a core-in-kettle heat exchanger. Natural gas from heat exchanger 50 is then introduced into separation vessel 52 where heavier hydrocarbons are separated from the natural gas and introduced to a demethanizer. Natural gas from separation vessel 52 is introduced to gas phase turbo-expander 56 via conduit 54. Within turbo-expander 56 the pressure of the natural gas is reduced, with work being extracted from the reduction in pressure. The work extracted during the reduction of pressure can be used to power the liquefaction process, such as the compressors, as mentioned below. Additionally, natural gas from separator 52 can be sent through conduit 58 and introduced into Joule-Thompson valve 60 for reduction in pressure. Joule-Thompson valve 60 is in a parallel by-pass flow relationship with respect to turbo-expander 56. During normal operation of the expander 56, Joule-Thompson valve 60 is in a closed position so as to preclude the flow of any natural gas through the conduit 58; in essence, causing the entire flow of natural gas to flow through the turbo-expander.

The utilization of the Joule-Thompson valve in flow by-pass relationship with the turbo-expander will ensure that during periods when the expander is inoperative, such as during repairs or replacement, the refrigeration system may continue operating without any significant down time being encountered, although, temporarily, at a reduced efficiency in the output or yield of liquid natural gas.

Figure 2:
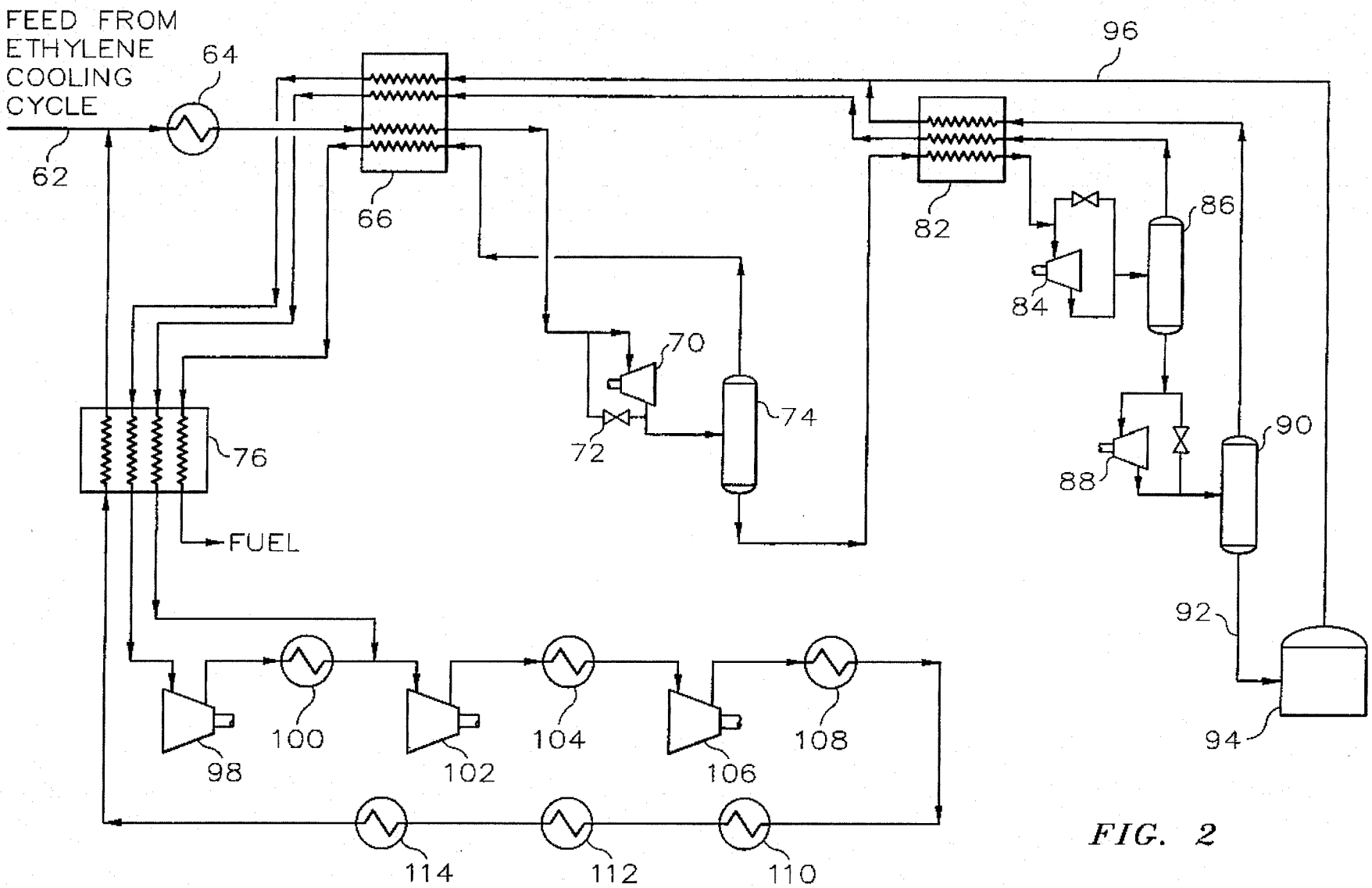
FIG. 2 shows a simplified flow diagram of the second portion of the liquefaction process according to the present invention.

The stream from turbo-expander 56 is typically a two-phase, liquid and gas stream and is introduced via conduit 62 to the final stage of the ethylene cooling cycle. With reference now to FIG. 2, the final stage of the ethylene cooling cycle can be seen wherein conduit 62 introduces the stream into heat exchanger 64, preferably a core-in-kettle heat exchanger, where it undergoes a final heat exchange with ethylene and substantially the entire stream is condensed to produce a liquefied natural gas (LNG) stream. The LNG stream from heat exchanger 64 is introduced into a first economizer 66, preferably, a plate-fin heat exchanger. Within economizer 66 the LNG stream undergoes heat exchange with at least one methane gas refrigerant stream. Preferably, the LNG stream will undergo heat exchange with a plurality of methane gas feed streams in the first economizer 66 to further reduce the LNG streams temperature. The LNG stream exiting from first economizer 66 is introduced into hydraulic expander 70 wherein the pressure of the LNG stream is reduced such that the temperature of the LNG stream is lowered and work is extracted. Hydraulic expander 70 is in parallel bypass relationship with the Joule-Thompson valve 72 as outlined above for turbo-expander 56. During the reduction of pressure within hydraulic expander 70, the temperature of the LNG stream is further reduced and at least a portion of the LNG stream is vaporized.

After pressure reduction in hydraulic expander 70, the LNG stream is introduced into a separation vessel 74 wherein vaporization cooling can occur. The gaseous portion is extracted from separation vessel 74 and is used as a first methane refrigerant stream to cool the LNG stream in first economizer 66. From first economizer 66 this first methane refrigerant stream is introduced into a second economizer 76 which is further explained below. The first methane refrigerant stream upon exiting third economizer 76 can be burned as fuel to provide power to help run the liquefaction process.

The LNG stream extracted from the bottoms of separation vessel 74 is further cooled in a third economizer 82, preferably a plate-fin heat exchanger, and then undergoes further pressure reduction in a second hydraulic expander 84. Second hydraulic expander 84 is in parallel bypass relationship with a Joule-Thompson valve similar to the previous expanders. Work is extracted during the pressure reduction of the LNG stream in hydraulic expander 84. During the pressure reduction in the second hydraulic expander 84, the LNG stream is at least partially vaporized and the temperature of the combined liquid and gas stream is lowered.

The combined methane stream from hydraulic expander 84 is introduced into a second separation vessel 86, wherein additional vaporization cooling can occur, for the separation of the liquid from the gaseous phases. The gaseous phase from separation vessel 86 is used as a second methane refrigerant stream to cool the LNG stream in economizer 82 by countercurrent, heat exchange contact. Next, the second methane refrigerant stream from economizer 82 is introduced into economizer 66 to cool the LNG stream and, subsequently, is introduced into economizer 76. The second methane refrigerant stream upon exiting economizer 76 is compressed, cooled and rejoined with the natural gas stream as described below.

The LNG stream from separation vessel 86 is expanded and work is extracted a third time in a hydraulic expander 88 similar to those described above. The LNG stream from hydraulic expander 88 is introduced into a third separation vessel 90, wherein additional vaporization cooling can occur. The gaseous phase from separation vessel 90 is introduced as a third methane refrigerant stream into economizer 82 to cool LNG from separation vessel 74, is then used to cool the LNG stream in economizer 66, and is introduced into economizer 76. The third methane refrigerant stream from economizer 76 is then compressed, cooled and rejoined with the natural gas stream, as described below. The LNG stream from separation vessel 90 is still above ambient pressure and is removed via conduit 92 for pumping to storage in storage tank 94 which is at approximately ambient pressure. During storage, gaseous vapors from storage tank 94 can be extracted via conduit 96, typically by use of a blower or compressor, and joined with gaseous methane from separation vessel 90 after the gaseous methane from separation vessel 90 has undergone heat exchange in economizer 82.

While the process has been illustrated utilizing hydraulic expanders 84 and 88 for greater efficiency, it should be understood that these hydraulic expanders can be replaced with Joule-Thompson valve to lower cost or for other reasons, but the process will operate at a reduced efficiency.

The second and third methane refrigerant streams from economizer 76 are compressed in a series of compressors, which can optionally be a single compressor having a series of compression stages, and cooled in a series of heat exchangers before they rejoin the LNG stream. In the illustrated embodiment, the third methane refrigerant stream is introduced into a compression stage 98 wherein its pressure is increased and subsequently, its temperature is also increased. From compression stage 98 the third gaseous refrigerant stream is introduced into heat exchanger 100 wherein it undergoes heat exchange with an appropriate cooling medium, such as chilled water. The third methane refrigerant stream is then joined with the second methane refrigerant stream and the combined stream is introduced into a second compression stage 102 wherein the combined stream is compressed and subsequently the temperature is raised. The combined stream from the second compression stage 102 is then cooled by heat exchange with an appropriate cooling medium in heat exchanger 104. The combined stream is compressed in a third compression stage 106 and subsequently cooled in a third heat exchanger 108.

Compression stages 98, 102 and 106 can be performed by a series of compressors or by a single compressor. Heat exchangers 100, 104 and 108 can use any appropriate heat exchange fluid such as chilled water or air. The combined stream from heat exchanger 108 is then further cooled by heat exchange with propane in propane heat exchangers 110, 112 and 114, preferably core-in-kettle heat exchangers. Generally, there will be one to three propane heat exchangers, with three providing the greatest efficiency. It is preferred that propane heat exchangers 110, 112 and 114 use propane refrigerant from the first, second and third propane coolant stages, respectively, so that each propane heat exchanger can cool the combined stream to successively lower temperatures. Finally, the combined stream is further cooled by heat exchange in economizer 76 with the plurality of methane refrigerant streams. After the combined stream has been cooled in economizer 76, it is at approximately the same pressure and temperature as the methane feed stream prior to the final stage of the ethylene cooling cycle and can be recombined with the natural gas stream prior to the final stage of the ethylene cooling cycle. Optionally, a portion of the combined stream can be withdrawn from economizer 76 during cooling and recombined with the natural gas stream prior to heat exchanger 50.

Work extracted by hydraulic expanders 70, 75, 84 and 88 can be converted to electrical energy or mechanical energy. The resulting electrical energy or mechanical energy can be used to power other parts of the refrigeration process such as pumps or compressors 98, 102, and 106.

Figure 3:
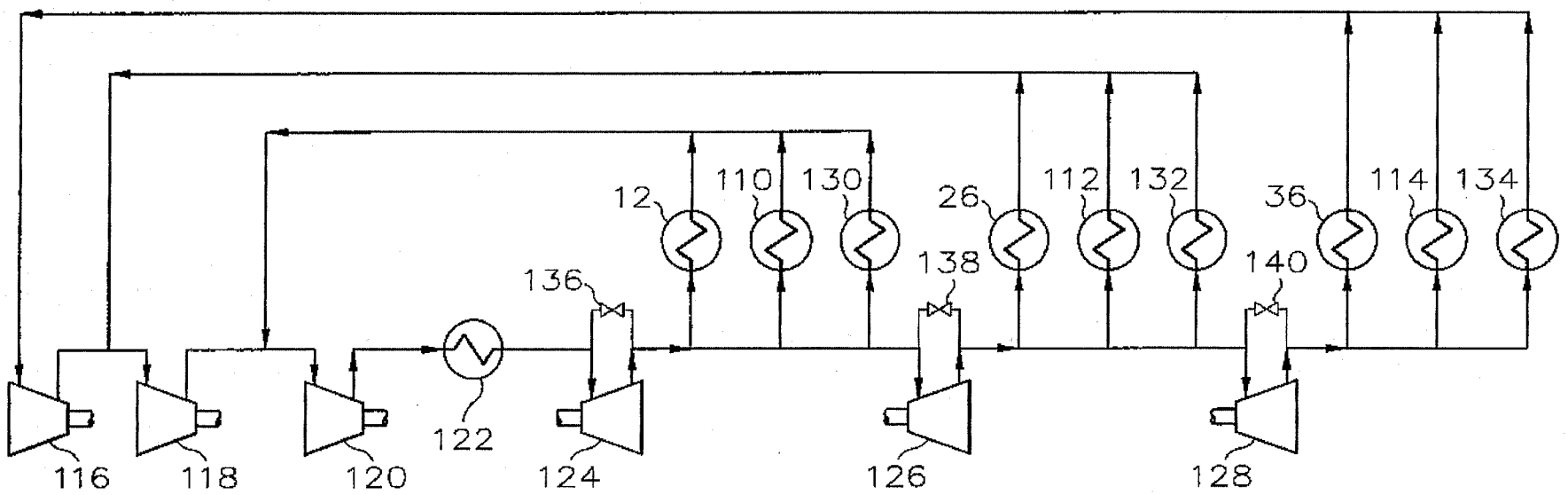
FIG. 3 shows a simplified flow diagram of the multi-stage refrigerant cycle of the first refrigerant of the process of FIGS. 1 and 2.

The refrigerant cycle for the propane refrigerant can be seen in FIG. 3. The propane refrigerant cycle comprises three compression stages, 116, 118 and 120 in which the propane is compressed, a heat exchanger 122 wherein the propane undergoes heat exchange with an appropriate cooling medium, such as chilled water or air, and three hydraulic expanders 124, 126 and 128, wherein the pressure of the propane is reduced in order to further cool the propane. In operation, propane is compressed in compression stages 116, 118 and 120, which may occur in one or more compressors, and cooled by heat exchange with chilled water or air in heat exchanger 122. The propane from heat exchanger 122 should be substantially all liquid. The liquid propane is introduced into hydraulic expander 124 where it undergoes pressure reduction and work is extracted during such pressure reduction. The pressure reduction further reduces the temperature of the propane. Propane from hydraulic expander 124 is then divided into four portions. The first three portions are used for the first propane cooling stage. The first portion is introduced to heat exchanger 12 where it undergoes heat exchange with the natural gas stream. The second portion is introduced to heat exchanger 110. The third portion is introduced into heat exchanger 130 where it will undergo heat exchange with ethylene in the ethylene refrigerant cycle, as described below for FIG. 4. After heat exchange in heat exchangers 12, 110 and 130, the first, second and third portions are joined together and the combined stream is rejoined with the propane entering compression stage 120.

The fourth portion from hydraulic expander 124 is introduced into hydraulic expander 126 where its pressure is further reduced and accordingly, its temperature is further reduced. Work is extracted during the pressure reduction and the propane from hydraulic expander 126 is then divided into four portions. The first three portions are used for the second propane cooling stage. The first portion is introduced into heat exchanger 26 for heat exchange with the methane feed stream. The second portion is introduced into heat exchanger 112. The third portion is introduced to heat exchanger 132 where it undergoes heat exchange with ethylene in the ethylene refrigerant cycle as described below. After heat exchange in heat exchangers 26, 112 and 132, the first, second and third portions of the propane stream from hydraulic expander 126 are combined together and introduced with the propane from compression stage 116 into compression stage 118.

The fourth propane portion from hydraulic expander 126 is introduced into hydraulic expander 128 for further expansion and accordingly, further reduction in temperature and work extraction. The propane from hydraulic expander 128 is then divided into three portions. These three portions are used for the third propane cooling stage. The first portion is introduced into heat exchanger 36 for heat exchange with the methane feed stream. The second portion is introduced into heat exchanger 114. The third portion is introduced to heat exchanger 134 where it undergoes heat exchange with ethylene during the ethylene refrigerant cycle, as described below. The first, second and third portions from heat exchangers 36, 114 and 134 respectively, are joined together and returned to compression stage 116.

Hydraulic expanders 124, 126 and 128 can be in parallel bypass relation with Joule-Thompson valves 136, 138 and 140 so that if the hydraulic expander must be taken off line, the propane can be expanded by means of the Joule-Thompson valve, although at less efficiency.

Figure 4:
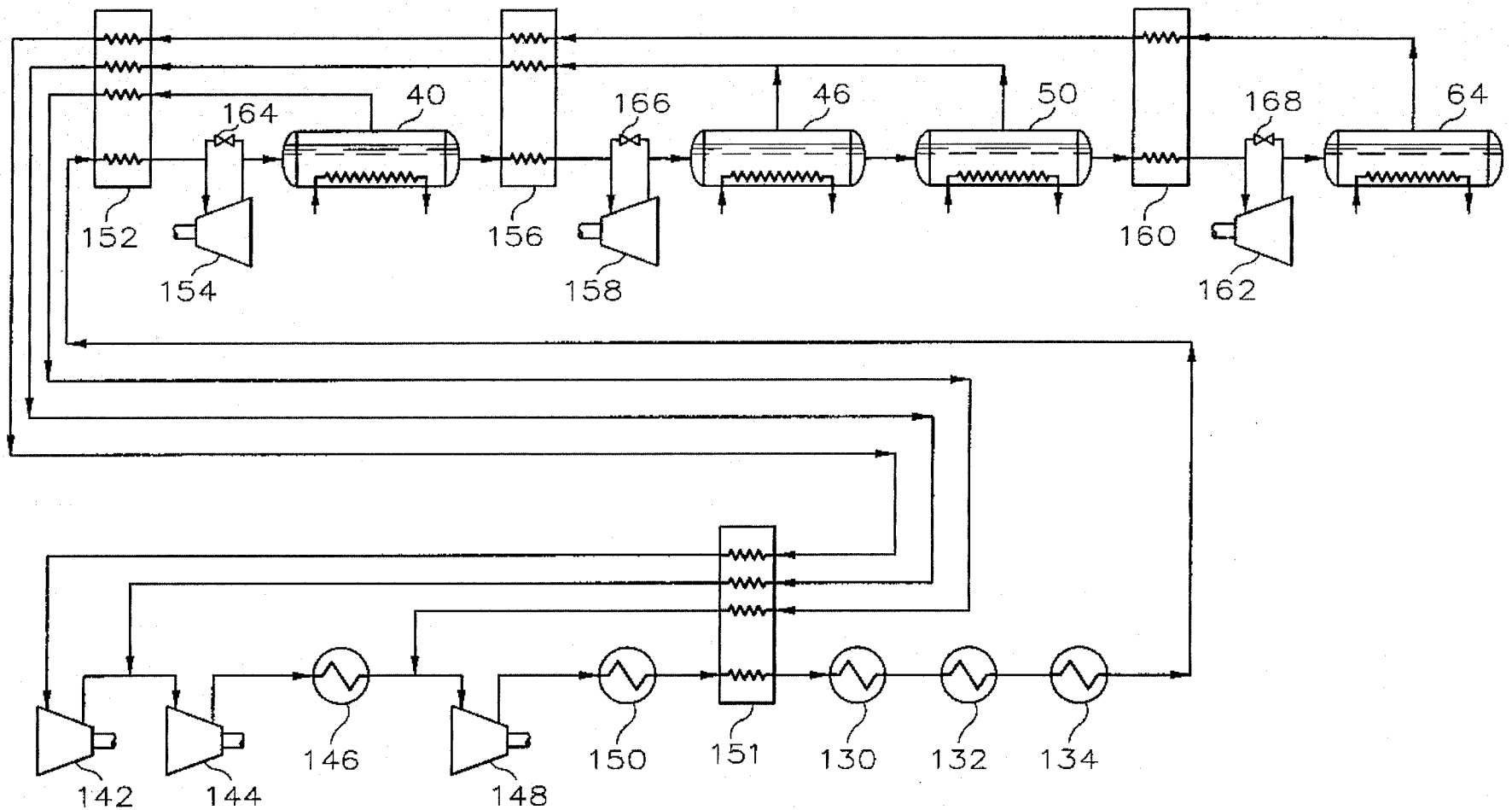
FIG. 4 shows a simplified flow diagram of the multi-stage refrigerant cycle of the second refrigerant of the process of FIGS. 1 and 2.

Turning now to FIG. 4, the ethylene refrigerant cycle is illustrated. Ethylene is first compressed in compression stages 142 and 144. It is then cooled by heat exchange with an appropriate cooling medium, such as chilled water or air, in heat exchanger 146. Next, the ethylene is further compressed in compression stage 148 and then cooled in a second chilled water heat exchanger 150. After being cooled in heat exchanger 150, the ethylene is further cooled in a first ethylene economizer 151 and in propane heat exchangers 130, 132 and 134. The thus cooled ethylene from heat exchanger 134 will be substantially all liquid and can be further cooled in a second ethylene economizer 152. The thus cooled ethylene is introduced into a first hydraulic expander 154 wherein the pressure of the ethylene is reduced and accordingly, the temperature is also reduced and work is extracted. Ethylene from hydraulic expander 154 undergoes heat exchange with the natural gas stream in heat exchanger 40. Within heat exchanger 40, liquid ethylene vaporizes during cooling to produce an ethylene gas. Ethylene gas from heat exchanger 40 is then introduced into second ethylene economizer 152 to cool the compressed ethylene stream by heat exchange. The ethylene gas, after heat exchange in the second ethylene economizer 152, is introduced to the first ethylene economizer 151 to cool the compressed ethylene stream by heat exchange and, subsequently, is joined with ethylene entering compression stage 148. A liquid portion of ethylene is extracted from heat exchanger 40 and is cooled in a third ethylene economizer 156 where it undergoes further cooling through heat exchange. The thus cooled ethylene from economizer 156 is expanded in hydraulic expander 158 to further reduce its temperature and pressure and to further extract work. The ethylene from hydraulic expander 158 is then introduced into heat exchanger 46 for heat exchange with the natural gas stream, as occurred in heat exchanger 40. A liquid ethylene portion is extracted from heat exchanger 46 and introduced into heat exchanger 50 for further heat exchange with the natural gas stream. A gaseous ethylene portion is extracted from both heat exchangers 46 and 50. The two gaseous ethylene portions are combined and undergo heat exchange in third ethylene economizer 156, second ethylene economizer 152 and first ethylene economizer 151, respectively. After the final heat exchange with the compressed ethylene in ethylene economizer 151, the gaseous ethylene portions from heat exchangers 46 and 50 are joined with the ethylene entering compression stage 144. Although represented as two heat exchangers, heat exchangers 46 and 50 can be replaced with a single heat exchanger if desired.

A liquid ethylene portion is extracted from heat exchanger 50 and is cooled in a fourth ethylene economizer 160 by heat exchange and, subsequently, is introduced into a third hydraulic expander 162 for reduction of pressure and temperature and for extraction of work. The ethylene from hydraulic expander 162 is then introduced to heat exchanger 64 for heat exchange with the natural gas stream in the final stage of the ethylene refrigerant cycle. Ethylene gas from heat exchanger 64 then undergoes heat exchange in the fourth, third, second, and first ethylene economizers, respectively. After undergoing heat exchange in the first ethylene economizer 151 the ethylene is returned to the first ethylene compression stage 142.

Similar to the prior hydraulic expanders, hydraulic expanders 154, 158 and 162 are in parallel bypass relation with Joule-Thompson valves 164, 166 and 168, respectively. Additionally, work extracted in hydraulic expanders 154, 158 and 162 during the pressure reduction of the ethylene can be used to at least partially power compressors 142, 144 and 148.

The hydraulic expanders used herein may be any suitable hydraulic expanders. The hydraulic expanders may be shaft-coupled to suitable compressors, pumps or generators, enabling the work extracted from the natural gas and refrigerants by the hydraulic expanders to be converted into usable mechanical and/or electrical energy, thereby resulting in a considerable energy savings to the overall system.

EXAMPLES

In order to determine the advantages of the present invention, comparative computer simulations of an entire liquid natural gas process and of a single stage propane refrigerant cycle were carried out. The results of the simulations are reported below in Examples A and B.

EXAMPLE A

A comparative computer simulation is carded out for the liquid natural gas process illustrated in FIGS. 1–4. A Base Case is selected in which adiabatic expansion valves (Joule-Thompson valves) are utilized instead of hydraulic expanders 70, 74, 84, 88, 124, 126, 128, 154, 158 and 162. An Expander Case is selected where the same hydraulic expanders are quasi-isentropic expanders which extract work from the hydraulic expansion. Both the Base Case and Expander Case are calculated for a feed stream flow rate of 200 MMSCFD (millions of standard cubic feet per day). The Base Case and Expander Case are compared to determine the difference in power usage. It is determined that the Expander Case uses 5,183 BHP less power than the Base Case. Additionally, it is determined that the expanders of the Expander Case results in the production of 4060 BHP which could be used to power the compressors or other parts of the liquid natural gas process.

EXAMPLE B

Figure 5:
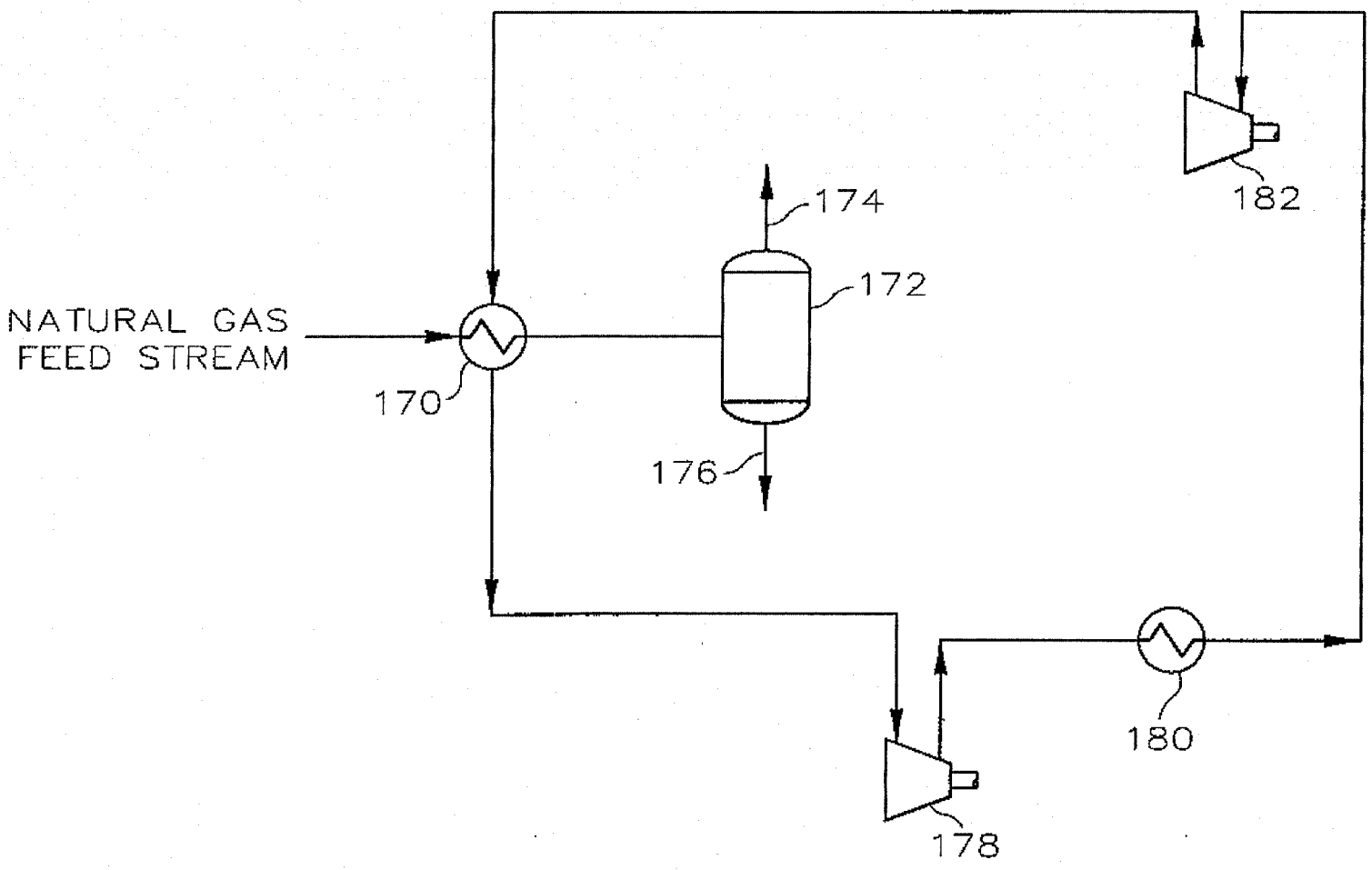
FIG. 5 shows a flow diagram for a simplified single-stage propane refrigerant cycle.

A comparative computer simulation is carried out for a single stage propane refrigerant cycle, as illustrated in FIG. 5. A Base Case is selected in which an adiabatic expansion valve (Joule-Thompson valve) is used instead of an expander. An Expander Case is selected in accordance with FIG. 5.

In FIG. 5, a natural gas feed stream is introduced into heat exchanger 170 where it undergoes heat exchange with a propane refrigerant. The resulting cooled feed stream is introduced into separator 172 where gaseous natural gas is separated from liquid natural gas. The gaseous natural gas is withdrawn via conduit 174 and the liquid natural gas is withdrawn via conduit 176. Propane from heat exchanger 170 is introduced to compressor 178 and the resulting compressed propane is cooled in heat exchanger 180 by heat exchange with chilled water. Propane from heat exchanger 180 is introduced to hydraulic expander 182 where it undergoes quasi-isentropic expansion so that the pressure and temperature of the propane are lowered and work is extracted. The work extracted during expansion is used to help power compressor 178. The propane from hydraulic expander 182 is returned to heat exchanger 170.

The Base Case and Expander Case are computed for a feed case and a resulting cooled feed case having the properties listed in Table I.

TABLE I

| | Feed Gas | Cooled Feed Gas |
|---|---|---|
| Temperature | 75° F. | 0° F. |
| Pressure | 650.0 psia | 645.0 psia |
| Flow | 250.0 MMSCFD | 250.0 MMSCFD |
| Mass-Flow | 440396.4 lb/hr | 440396.4 lb/hr |

The power used in cooling the feed gas is calculated for the Base Case and Expander Case. The Base Case used 3235.4 BPH and the Expander Case used 3089.0 BPH. Thus, there was a reduction of 146.4 BPH in the power needed to cool the feed stream.

From the foregoing examples it becomes apparent to one skilled in the technology that there is a significant reduction in the power needed for the inventive liquefied gas process by employing hydraulic expanders capable of extracting work during operation. Moreover, from Example A it is evident that not only does the use of such hydraulic expanders reduce the power need by extracting work during operation but, also, power need is reduced because of the greater efficiency of the hydraulic expander.

While there has been shown and described what is considered to be the preferred embodiment of the invention, it will of course be understood that various modifications and changes in form or detail could readily be made without departing from the spirit of the invention. It is therefore intended that the invention not be limited to the exact form or detail herein shown and described, nor to anything less than the whole of the invention herein disclosed as hereinafter claimed.

That which is claimed:

1. A process for producing liquefied natural gas, from a pressurized natural gas feed stream, which is predominantly methane and has an initial pressure above 500 psia, comprising:

(a) introducing said feed stream into heat exchange contact with a first refrigerant cycle wherein the temperature of said feed stream is reduced by heat exchange with a first portion of a first refrigerant having a first boiling point, to thus produce a first cooled stream;

(b) introducing said first cooled stream into heat exchange contact with a second refrigerant cycle wherein the temperature of said first cooled stream is reduced by heat exchange with a second refrigerant, having a second boiling point lower than said first boiling point, to thus produce a second cooled stream and wherein within said second refrigerant cycle said second refrigerant is subsequently compressed and, at least partially, cooled and condensed by heat exchange with a second portion of said first refrigerant; and (c) reducing the pressure and temperature of said second cooled stream in a series of cooling and expansion steps utilizing at least one heat exchanger, at least one hydraulic expander and at least one separation vessel to produce a liquid natural gas stream at about atmospheric pressure, wherein said second cooled stream is cooled within said heat exchanger by heat exchange with a third refrigerant having a third boiling point lower than said second boiling point, said pressure of said second cooled stream is reduced in said hydraulic expander such that the temperature of said second cooled stream is further reduced and work is extracted during said pressure reduction, and a gaseous phase is separated from said second cooled stream in said separation vessel.

2. A process according to claim 1 wherein said third refrigerant is said gaseous phase from said separation vessel.

3. A process according to claim 2 further comprising after said heat exchange with said second cooled stream, compressing and cooling at least a portion of said gaseous phase and, subsequently, joining said portion of said thus compressed and cooled gaseous phase with said second cooled stream prior to step (c).

4. A process according to claim 3 wherein said work extracted in step (c) is used to at least partially compress said portion of said gaseous phase.

5. A process according to claim 4 wherein said portion of said gaseous phase is cooled after compression by heat exchange with a third portion of said first refrigerant.

6. A process according to claim 4 wherein said portion of said gaseous phase is cooled after compression by heat exchange with said second refrigerant.

7. A process according to claim 1 wherein step (c) comprises:

cooling in a first heat exchanger said second cooled stream by heat exchange with a third refrigerant comprising a first plurality of methane gas streams to produce a third cooled stream;

reducing the pressure of said third cooled stream thereafter by conducting said third cooled stream through a first hydraulic expander wherein the temperature of said third cooled stream is reduced and work is extracted during said reduction of pressure by means of said first hydraulic expander;

separating said third cooled stream after said reduction of pressure into a first gaseous stream and a first liquid stream;

introducing said first gaseous stream to said first heat exchanger as one of said first plurality of methane gas streams for heat exchange with said second cooled stream;

cooling in a second heat exchanger said first liquid stream by heat exchange with a second plurality of methane gas streams;

reducing the pressure of said first liquid stream thereafter by conducting said first liquid stream through a second hydraulic expander wherein the temperature of said first liquid stream is further reduced and work is extracted during said reduction of pressure by means of said second hydraulic expander;

separating said first liquid stream after said reduction of pressure into a second gaseous stream and a second liquid stream;

introducing said second gaseous stream to said second heat exchanger as one of said second plurality of methane gas streams for heat exchange with said first liquid stream;

introducing said second gaseous stream from said second heat exchanger to said first heat exchanger as one of said first plurality of methane gas streams for heat exchange with said second cooled stream;

reducing the pressure of said second liquid stream by conducting said second liquid stream through a third hydraulic expander wherein the temperature of said second liquid stream is reduced and work is extracted during said reduction of pressure by means of said third hydraulic expander;

separating said second liquid stream after said reduction of pressure into a third gaseous stream and a third liquid stream at about atmospheric pressure;

introducing said third gaseous stream to said second heat exchanger as one of said second plurality of methane gas streams for heat exchange with said first liquid stream;

introducing said third gaseous stream from said second heat exchanger to said first heat exchanger as one of said first plurality of methane gas streams for heat exchange with said second cooled stream;

introducing said third liquid stream to a storage tank for storage;

removing any methane vapors produced in said storage tank;

introducing said vapors to said first heat exchanger for heat exchange with said second cooled stream;

compressing and combining said second gaseous stream, said third gaseous stream and said vapors into a compressed stream after they have undergone heat exchange in said first heat exchanger;

cooling said compressed stream to a reduced temperature by heat exchange with a third portion of said first refrigerant; and introducing the thus cooled, compressed stream into said second cooled stream prior to said step (c).

8. A process for producing liquefied natural gas, from a pressurized natural gas feed stream, which is predominantly methane and has an initial pressure above 500 psia, comprising:

(a) introducing said feed stream into heat exchange contact with a first refrigerant cycle wherein the temperature of said feed stream is reduced by heat exchange with a first portion of a first refrigerant having a first boiling point, to thus produce a first cooled stream;

(b) introducing said first cooled stream into heat exchange contact with a second refrigerant cycle wherein the temperature of said first cooled stream is reduced by heat exchange with a second refrigerant having a second boiling point lower than said first boiling point, to thus produce a second cooled stream;

(c) compressing said second refrigerant after it has undergone heat exchange with said first cooled stream to increase said pressure of said second refrigerant;

(d) cooling said second refrigerant after said compressing of said second refrigerant by heat exchange with a second portion of said first refrigerant to thus decrease the temperature of said second refrigerant and at least partially condense it;

(e) reducing the pressure of said thus cooled second refrigerant in a second refrigerant hydraulic expander to further reduce the temperature of said second refrigerant wherein work is extracted from said second refrigerant during said reduction of pressure by means of said second refrigerant hydraulic expander;

(f) thereafter returning said second refrigerant for heat exchange with said first cooled feed stream;

(g) combining said first portion of said first refrigerant, after it has undergone heat exchange with said feed stream, with said second portion of said first refrigerant, after it has undergone heat exchange with said second refrigerant, to produce a first refrigerant stream;

(h) compressing said first refrigerant stream to increase the pressure of said first refrigerant stream;

(i) cooling said first refrigerant stream after said compressing of said first refrigerant stream by heat exchange with a cooling medium, to thus decrease the temperature of said first refrigerant stream and at least partially condense it;

(j) reducing the pressure of said thus cooled first refrigerant stream in a first refrigerant hydraulic expander to further reduce the temperature of said first refrigerant stream wherein work is extracted from said first refrigerant stream during said reduction of pressure by means of said first refrigerant hydraulic expander; and (k) thereafter splitting said first refrigerant stream into said first portion of said first refrigerant and said second portion of said first refrigerant and returning said first portion for heat exchange with said feed stream and returning said second portion for heat exchange with said second refrigerant.

9. A process according to claim 8 wherein said work extracted by said first refrigerant hydraulic expander is used, at least partially, to compress said first refrigerant stream and said work extracted by said second refrigerant hydraulic expander is used, at least partially, to compress said second refrigerant.

10. A process according to claim 8 further comprising:

reducing the pressure and temperature of said second cooled stream in a series of cooling and expansion steps utilizing at least one heat exchanger, at least one hydraulic expander and at least one separation vessel to produce a liquid methane stream at about atmospheric pressure, wherein said second cooled stream is cooled by heat exchange with a third refrigerant having a third boiling point lower than said second boiling point, said pressure of said second cooled stream is reduced in said at least one hydraulic expander such that the temperature of said second cooled stream is further reduced and work is extracted during said pressure reduction, and a gaseous phase is separated from said second cooled stream in said at least one separation vessel.

11. A process according to claim 10 wherein said third refrigerant is said gaseous phase from said separation vessel.

12. A process according to claim 11 further comprising, after said heat exchange with said second cooled stream, compressing and cooling at least a portion of said gaseous phase and joining said portion of said gaseous phase with said second cooled stream prior to reducing the pressure and temperature of said second cooled stream.

13. A process according to claim 12 wherein said portion of said gaseous phase is cooled after compression by heat exchange with a third portion of said first refrigerant.

14. A process according to claim 13 wherein said portion of said gaseous phase is cooled after compression by heat exchange with said second refrigerant.

15. A process according to claim 8 further comprising:

cooling in a first heat exchanger said second cooled stream by heat exchange with a first plurality of methane gas streams to produced a third cooled stream;

reducing the pressure of said third cooled stream thereafter by conducting said third cooled stream through a first hydraulic expander wherein the temperature of said third cooled stream is reduced and work is extracted during said reduction of pressure by means of said first hydraulic expander;

separating said third cooled stream after said reduction of pressure into a first gaseous stream and a first liquid stream;

introducing said first gaseous stream to said first heat exchanger as one of said first plurality of methane gas streams for heat exchange with said second cooled stream;

cooling in a second heat exchanger said first liquid stream by heat exchange with a second plurality of methane gas streams;

reducing the pressure of said first liquid stream thereafter by conducting said first liquid stream through a second hydraulic expander wherein the temperature of said first liquid stream is further reduced and work is extracted during said reduction of pressure by means of said second hydraulic expander;

separating said first liquid stream after said reduction of pressure into a second gaseous stream and a second liquid stream;

introducing said second gaseous stream to said second heat exchanger as one of said second plurality of methane gas streams for heat exchange with said first liquid stream;

introducing said second gaseous stream from said third heat exchanger to said first heat exchanger as one of said first plurality of methane gas streams for heat exchange with said second cooled stream;

reducing the pressure of said second liquid stream by conducting said second liquid stream through a third hydraulic expander wherein the temperature of said second liquid stream is reduced and work is extracted during said reduction of pressure by means of said third hydraulic expander;

separating said second liquid stream after said reduction of pressure into a third gaseous stream and a third liquid stream at about atmospheric pressure;

introducing said third gaseous stream to said second heat exchanger as one of said second plurality of methane gas streams for heat exchange with said first liquid stream;

introducing said third gaseous stream from said second heat exchanger to said first heat exchanger as one of said first plurality of methane gas streams for heat exchange with said second cooled stream;

introducing said third liquid stream to a storage tank for storage;

removing any methane vapors produced in said storage tank;

introducing said vapors to said first heat exchanger as one of said first plurality of methane gas streams for heat exchange with said second cooled stream;

compressing and combining said second gaseous stream, said third gaseous stream and said vapors into a compressed stream after they have undergone heat exchange in said first heat exchanger;

cooling said compressed stream to a reduced temperature by heat exchange with a third portion of said first refrigerant; and introducing the thus cooled, compressed stream into said second cooled stream prior to said cooling of said second cooled stream in said first heat exchanger.

* * * * *